US007942287B2

(12) United States Patent
King

(10) Patent No.: US 7,942,287 B2
(45) Date of Patent: May 17, 2011

(54) BOTTLE AND CLOSURE ASSEMBLY WITH IMPROVED LOCKING ELEMENTS

(76) Inventor: Roger Milner King, Latimer (GB)

( * ) Notice: Subject to any disclaimer, the term of this patent is extended or adjusted under 35 U.S.C. 154(b) by 837 days.

(21) Appl. No.: 10/582,437

(22) PCT Filed: Dec. 3, 2004

(86) PCT No.: PCT/GB2004/005099

§ 371 (c)(1),
(2), (4) Date: Sep. 5, 2006

(87) PCT Pub. No.: WO2005/058720

PCT Pub. Date: Jun. 30, 2005

(65) Prior Publication Data

US 2007/0144999 A1 Jun. 28, 2007

(30) Foreign Application Priority Data

Dec. 19, 2003 (GB) ..... 0329444.4

(51) Int. Cl.
*B65D 41/06* (2006.01)

(52) U.S. Cl. ..... 220/296; 215/307; 215/329; 215/330; 215/331; 220/293; 220/300

(58) Field of Classification Search ..... 215/307, 215/329, 330, 331; 220/296, 293, 300
See application file for complete search history.

(56) References Cited

U.S. PATENT DOCUMENTS

| | | | | |
|---|---|---|---|---|
| 3,435,978 | A * | 4/1969 | Wittwer | 215/217 |
| 4,084,717 | A * | 4/1978 | King | 215/217 |
| 4,090,629 | A | 5/1978 | Hedgewick | |
| 6,109,466 | A | 8/2000 | Carrier | |
| 6,227,391 | B1 | 5/2001 | King | |
| 2005/0056613 | A1 | 3/2005 | King | |

FOREIGN PATENT DOCUMENTS

| | | |
|---|---|---|
| EP | 1401724 B1 | 1/2003 |
| GB | 2330356 A | 4/1999 |
| GB | 2330356 A | 4/1999 |
| GB | 1369114 A | 5/2002 |

(Continued)

*Primary Examiner* — Anthony Stashick
*Assistant Examiner* — Elizabeth Volz
(74) *Attorney, Agent, or Firm* — Mark F. Smith; Smith Brandenburg Ltd

(57) ABSTRACT

A threaded container closure assembly, comprising: a container neck (10) having an opening; a closure (12) for said neck, the closure having a base portion (22) and a skirt portion (24), a first screw thread on the neck said first screw thread comprising one or more first thread segments (16), and a second screw thread on an inner surface of the skirt of the closure, said second screw thread comprising one or more second thread segments (26); a first locking projection (44) on the container neck separate from the first thread segments (16) and a second locking projection (46) on the inner surface of the skirt of the closure separate from the second thread segments (26), said first and second locking projections being configured to resist unscrewing of the closure from the fully engaged position on the container neck after the closure has been secured or resecured on the container neck until a predetermined minimum opening torque is applied; wherein said first and second locking projections (44, 46) longitudinally overlap the first or the second thread segments when the closure is in the fully engaged position on the container neck.

13 Claims, 2 Drawing Sheets

FOREIGN PATENT DOCUMENTS

| | | | |
|---|---|---|---|
| GB | 2369114 | A | 5/2002 |
| GB | 2382071 | A | 5/2003 |
| JP | 54-078172 | | 6/1979 |
| JP | 57-139832 | | 9/1982 |
| WO | WO95/05322 | | 2/1995 |
| WO | WO 03/004373 | | 1/2003 |

* cited by examiner

BOTTLE AND CLOSURE ASSEMBLY WITH IMPROVED LOCKING ELEMENTS

The present invention relates to improved threaded closure assemblies for containers.

Current commercially mass-produced beverage containers use threads on the container neck and closure of the continuous, helical type. The threads comprise a single, substantially continuous thread portion on the container neck with a low thread pitch angle, typically less than 5°. The low pitch angle is needed in order to ensure that the closure does not unscrew spontaneously. The low pitch angle also provides the necessary leverage to achieve an air tight compressive seal between the closure and the container neck when the closure is tightened onto the container neck. The low pitch of the helical threads also generally means that existing closures typically need to be rotated through more than 360° to disengage it completely from the container neck.

Drawbacks of these low pitch helical threads include the laborious rotation required to remove and resecure the closure on the neck, excessive use of moulding material to form the long helical threads, and unreliable separation of tamper-evident rings from the closure skirt due to the low pitch angle of the threads.

The present applicant has described an improved and safer closure for both carbonated and non-carbonated beverage containers in International Patent application WO95/05322. This application describes container closure assemblies having substantially continuous threads defining a substantially continuous helical thread path. The closure can be moved from a fully disengaged to a fully secured position on the container neck by rotation through 360° or less. In order to prevent the closure from backing off from the fully secured position on the neck, and to maintain the closure in the optimum sealing position, the closure assemblies are also provided with complementary locking elements (hereinafter also referred to as "side catches") on the container neck and on the closure skirt that snap into engagement at the fully secured position of the closure on the neck, and that resist unscrewing of the closure until a predetermined minimum opening torque is applied. In the assemblies of WO95/05322, the locking elements are provided by a locking rib on the closure skirt below the closure thread that engages with a locking recess on the container neck situated below the neck thread. In addition, the side catches cooperate in the fully closed position of the assembly to urge the closure into the sealing position as discussed in more detail in our application WO93/01098, the entire content of which is incorporated herein by reference.

In the assemblies of WO95/05322, the threads on the neck or the closure are also provided with mutually engageable elements to block or restrict rotation of the closure in an unscrewing direction beyond an intermediate position when the closure is under an axial pressure in a direction emerging from the container neck, the neck and closure being constructed and arranged to provide a vent for venting gas from the container neck at least when the closure is in the intermediate position. This pressure safety feature prevents the closure from blowing off uncontrollably once unscrewing of the closure from the container neck has started. It thus allows the use of shorter, more steeply pitched or multiple-start threads in the container and closure assembly, thereby rendering the assembly much more elderly- and child-friendly without sacrificing pressure safety.

WO97/21602 and WO99/19228 describe improved versions of the assemblies of WO95/05322. All of these improved versions have locking elements similar to those described in WO95/05322.

The beverage container closure assemblies exemplified in WO95/05322 have short projecting thread segments on the cap and longer projecting thread segments on the container neck. This arrangement is conventional, in part because of the requirements of high-speed injection moulding of the caps, according to which the caps must be "bumped" off a (preferably) one-piece mould mandrel with minimum distortion. WO03/045806 describes similar assemblies in which a smoother neck finish has been achieved by using short thread segments on the neck and longer thread segments on the inside of the closure skirt, with interruptions being provided in the thread segments of the closure to make the closures easier to manufacture.

U.S. Pat. No. 5,462,166 (Ladina) describes threaded container and closure assemblies for carbonated beverage containers. The threads include stops and tapered speed bumps to impede the threads in order to effect a delay during opening to allow gas venting from the container. The threads may also comprise anti-backoff devices to resist accidental opening when the closure is in the fully secured position on the neck. The anti-backoff devices are formed by small, complementary projections formed integrally with the threads of the container and the neck that engage at the fully secured position of the closure on the neck. These small projections are prone to distortion and wear, cannot provide precise and stable control over the minimum opening torque, do not provide an ongoing self-closing effect, and do not provide a click to indicate to the user when the fully secured position of the closure on the neck has been reached. Furthermore, the small projections require the cap and closure to be manufactured with high precision (extremely low tolerances) if a satisfactory sealing of the assembly and engagement of the projections are to be achieved. In practice, this is difficult to achieve in mass production.

To provide larger locking projections on the container and closure assemblies of the prior art would interfere with the smooth running of the threads and hence hinder the closing of the assembly.

Interestingly, the various screw-top formats for beverage containers have not yet completely replaced glass bottles with crown closures. This is despite the fact that crown closures require a bottle opener to open, and cannot be resecured on the bottle neck in airtight fashion, thereby making it necessary to consume the whole contents of such a bottle immediately after opening, this being a serious inconvenience for the user.

The present applicant considers that one of the reasons for the incomplete acceptance of threaded closures for beverage containers is that threaded closures are relatively expensive, in part due to the quantity of moulding material that is needed to form the neck finish. Another reason for the continued use of crown closures is that the rounded neck finish of a crown closure makes it easier and more comfortable for a consumer to drink directly from the neck of the container. Another advantage of crown closures over existing screw-top closures is their compact size. Their serious disadvantage is that they cannot be closed.

It is an object of the present invention to provide improved resealable screw top closure assemblies for containers. The present invention is especially applicable to beverage and food containers, including carbonated beverage containers.

The present invention provides a threaded container closure assembly, said assembly comprising: a container neck having an opening; a closure for said neck, the closure having a base portion and a skirt portion; a first screw thread on the neck, said first screw thread comprising one or more first thread segments, and a second screw thread on an inner surface of the skirt of the closure, said second screw thread comprising one or more second thread segments, said first and second screw threads being configured to enable a user to secure, remove and resecure the closure into a sealing position on the neck by rotation of the closure on the neck; a first locking projection on the container neck separate from the first thread segments and a second locking projection on the inner surface of the skirt of the closure separate from the second thread segments, said first and second locking projections being configured to resist unscrewing of the closure from the fully engaged position on the container neck after the closure has been secured or resecured on the container neck until a predetermined minimum opening torque is applied; wherein said first and second locking projections longitudinally overlap the first or the second thread segments when the closure is in the fully engaged position on the container neck.

The container neck is preferably formed from thermoplastic material, that is to say from a moulded polymer, using conventional methods such as injection moulding and/or blow moulding. The neck may also be formed in similar fashion from glass.

The closure is preferably made from injection-moulded thermoplastic, and in certain embodiments of the present invention the closures can easily be manufactured by high-speed injection moulding, as will be described further below. The slight flexibility of the closure skirt provides enables the locking projections (side catches) on the skirt to ride over the locking projections (side catches) on the container neck as the sealing position is approached by temporarily deforming the skirt. The skirt may be deformed towards a generally oval shape or a generally square shape. The resilience of the skirt exerts a radial restoring force that can be leveraged by the slope of the side catches.

The mean inside diameter of the neck may be typical for carbonated beverage containers, for example about 1.5 to about 3 cm. In other embodiments the neck has a larger diameter to assist drinking or pouring from the neck, for example a mean inside diameter of from about 3 to about 8 cm, preferably from about 4 to about 6 cm. Neck diameters up to 25 cm are possible using the same principles. It will be appreciated that the present invention can be applied to both pressurized and non-pressurized containers, and to containers for all kinds of substances, not just beverages.

Preferably, there are at least two of said first thread segments. More preferably, there are at least four of said first thread segments. In the larger neck formats especially there may be six, eight, ten, twelve, sixteen or more of the first thread segments. The number of second thread segments is typically the same as the number of first thread segments. Preferably, this results in a number of thread starts equal to the number of first thread segments, or preferably at least two thread starts, more preferably at least four, such as six, eight or sixteen thread starts.

In preferred embodiments, the first thread segments on the container neck are shorter than the second thread segments. That is to say, they extend radially around the neck by a smaller angle than the angle through which the second thread segments extend around the closure skirt. Preferably, the first thread segments do not extend all the way around the neck, and preferably they do not overlap around the container neck. Preferably, at least one of the first thread segments extends circumferentially from about 1 to about 60 degrees around the container neck, more preferably from about 2 to about 45 degrees, more preferably from about 5 to about 30 degrees, more preferably from about 10 to about 20 degrees, and more preferably all of the first thread segments so extend. Preferably, the maximum length of each first thread segment (in plane projection) is from about 2 to about 20 mm, more preferably from about 4 to about 15 mm, more preferably from about 6 to about 12 mm. Preferably, all of the first thread segments have substantially the same shape and configuration, whereby the number of thread starts may be equal to the number of first thread segments.

The term "first thread segment" typically refers to an elongate, pitched projection on the container neck. It does not typically refer to a simple projecting boss or peg. The mean pitch of the first thread segment surfaces is preferably from about 5° to about 25°, more preferably from about 10° to about 20°. The upper and lower surfaces of the first thread segments may have different pitches, and the pitch along one or other of said surfaces may also vary. Preferably, at least one of said surfaces has at least one constant pitch region extending for at least 5° around the container neck. For example, the first thread segment may be a short helical thread segment having rounded ends, similar to the thread segments on the closure caps described in detail in WO95/05322 or WO97/21602.

The first thread segments may be substantially triangular, rectangular, rounded or chamfered rectangular, or trapezoidal in cross-section along the longitudinal axis of the neck. Preferably, the first thread segments are smoothed. That is to say, at least one edge of the segments is shaped to present a rounded or chamfered cross-section along the longitudinal axis of the neck instead of a triangular, rectangular or trapezoidal cross-section between the side of the segment and the top of the segment. Preferably, substantially all of the edges of the segment are smoothed in this way. Preferably, this results in an increased radius of curvature between the top of the segment and the side of the segment relative to the prior art. For example the radius of curvature may be at least 0.5 mm, more preferably at least 1 mm or 2 mm. Preferably, the cross-section of the segments taken along the longitudinal axis of the neck is a substantially continuous curve such as a semi-circle or sinusoidal curve. This smoothed profile improves the user-friendliness of the neck thread finish.

Preferably, the maximum radial height of the first thread segments above the cylindrical base of the neck finish is greater than 0.1 mm, more preferably greater than 0.2 mm and still more preferably from 0.5 to 3 mm, most preferably from 1 to 2 mm. Preferably, the width of the first thread segments (measured along the longitudinal axis of the container neck) is from 1 mm to 6 mm, more preferably from 2 mm to 4 mm. The use of such relatively large and high thread segments helps make it possible to produce a user-friendly neck finish onto which a suitable screw top can be secured and resecured in pressure-secure fashion. Nevertheless, the shortness of the first thread segments (usually shorter than the closure threads) and the usual rounded or smoothed cross-section of the first thread segments enables the relatively high neck finish to be made user-friendly, in particular to be made comfortable to the lips of a user drinking directly from the neck.

Preferably, the second thread segments on the inside of the closure skirt define a substantially continuous helical thread path along which the first thread segments travel from a substantially fully disengaged to a substantially fully secured position of the closure on the container neck. That is to say, the first and second threads do not engage in a stepped fashion like a bayonet closure (which is normal for short thread segments), but rather in a conventional continuous helical screw fashion. In other words, the pitch of the thread path is normally less than 90 degrees throughout its length. It will be appreciated that the pitch of the helix may not be constant. Preferably, the mean pitch of the helical thread path is from 5 to 20 degrees for a typical carbonated beverage assembly as hereinbefore described. The pitch may differ for wide-mouth assemblies as hereinbefore described.

The continuous thread path renders the assembly especially easy to close by the elderly and infirm, and by children. In contrast, bayonet-type threads require a relatively complex, stepped manipulation to secure the closure onto the container neck, with the result that the closure is often inadequately secured on the container neck. Furthermore, it is extremely difficult to devise a tamper-evident ring for the closure that separates reliably and easily upon opening of a bayonet-type closure assembly. A continuous thread is easier for physically weak people to screw down against pressure from inside the container than a bayonet thread.

The second thread segments are not bayonet-type thread segments. The second thread segments extend around the closure skirt a sufficient distance so that a top portion of one thread segment is proximate to a bottom portion of another thread segment, and preferably overlaps the other thread segment for a finite angular distance around the closure skirt. That is to say, preferably respective top and bottom portions of adjacent second thread segments are circumferentially overlapping. Preferably, at least one of the second thread segments extends for at least 45° around the closure skirt, more preferably at least 60° around the closure skirt, more preferably at least 90°. A thread gap is defined between the said top and bottom portions of the thread segments. One of the first thread segments travels through this thread gap as the closure is screwed onto or off the container neck.

Preferably, there are four, six, eight, twelve or sixteen of the second thread segments. Preferably the first and second thread segments define a four-start, six-start, eight-start, twelve start or sixteen start substantially continuous and fast-pitched thread path.

Preferably, the closure can be moved from a fully released to a fully engaged position on the container neck (or vice-versa) by a single smooth rotation through about 360 degrees or less, more preferably about 160 degrees or less, and most preferably about 90 degrees or less.

Preferably, the maximum radial height of the second thread segments above the cylindrical surface of the closure skirt is greater than about 0.1 mm, more preferably greater than about 0.2 mm and still more preferably from about 0.5 to about 3 mm, most preferably from about 1 to about 2 mm. Preferably, the width of the second thread segments (measured along the longitudinal axis of the closure skirt) is from about 1 mm to about 6 mm, more preferably from about 2 mm to about 4 mm.

The second thread segments are each preferably made up of one or more radially spaced projecting portions, each said portion extending radially no more than about 60° around the closure skirt, preferably no more than about 45° around the closure skirt, more preferably from about 2° to about 35° around the closure skirt. The radially spaced projecting portions are preferably radially spaced apart by gaps extending radially from 0 to about 10°, preferably from about 0.5° to about 2°. Preferably, the width of gaps is from about 0.1 mm to about 5 mm, more preferably from about 0.5 mm to about 2 mm. In other words, the second (preferably longer) thread is preferably a broken or interrupted thread having a plurality of gaps in each thread segment, but the gaps being sufficiently radially narrow not to interfere with the operation of the second thread segments. That is to say, the second thread segments still define a substantially continuous helical thread path therebetween. This requires the gaps in the second thread segments (as well as the gaps between the second thread segments) to be radially narrower than the first thread segments.

Preferably, each second thread segment is made up of at least two portions, preferably at least three or four portions, and this implies at least one or preferably at least two or three gaps in the thread segment. The presence of the gaps in the second thread segments may improve gas venting through the second thread when opening pressurised containers. More importantly, the closure caps are easier to bump off a one-piece mould mandrel during high speed manufacturing, because the broken threads offer less resistance to radial expansion of the closure skirt when bumping off the mould.

Preferably, at least one (and more preferably all) of the second thread segments also has a smoothed cross section. The second thread cross section is preferably complementary to the cross section described above for the first thread segments.

It will be appreciated that this can result in a better fit between the first and second thread segments, for example if they have matching cross-sectional shapes parallel to the axis of rotation. Moreover, tapered or smoothed threads on the closure also makes it easier to bump the closure off a mould mandrel, thereby assisting high-speed manufacture of the closures by injection moulding without the need for multi-part or collapsing core mould pieces.

It will be appreciated that the preferred features of the shape and configuration of the first and second thread segments have been described above for embodiments having a relatively short thread segments on the neck and relatively long thread segments on the closure skirt. However, it will be appreciated that within the scope of the present invention also lies the alternative configurations having relatively short thread segments on the closure skirt and relatively long thread segments on the container neck, for example as described in WO95/05322. The various features that are described above in connection with the primary configuration are also applicable mutatis mutandis to the alternative configuration.

In certain embodiments, the container closure assembly according to the invention is an assembly for a carbonated beverage, wherein the container further comprises mutually engageable elements on the neck and the closure to block or restrict rotation of the closure in an unscrewing direction beyond an intermediate position when the closure is under axial pressure in a direction emerging from the container neck. This is the so-called pressure safety feature that is intended to prevent the closure unscrewing uncontrollably or missiling as it is removed from a container neck under pressure. Preferably, the preferred embodiments of this pressure safety feature are as described in WO95/05322, WO97/21602 and WO99/19228, the entire contents of which are expressly incorporated herein by reference.

Preferably, the first and second screw threads are constructed and arranged to permit axial displacement of the closure relative to the neck at least when the closure is at the said intermediate position, and preferably the engageable elements are adapted to engage each other when the closure is axially displaced in a direction emerging from the neck, for example by axial pressure from inside the pressurized container. More preferably, the mutually engageable elements are constructed and arranged not to mutually engage each other when the closure is axially displaced in a direction inwardly towards the neck at the intermediate position, for example when the closure is being screwed down onto the container neck.

Preferably, the mutually engageable elements comprise a step or recess formed in the lower surface of one of the second screw thread segments to provide a first abutment surface against which a second abutment surface on one of the first screw thread segments abuts to block or restrict rotation of the closure in an unscrewing direction at the said intermediate position when the closure is under axial pressure in a direction emerging from the container neck, but which allows easy removal of the closure when the container is not unduly pressurized.

More preferably, the second thread segment comprises a first thread portion having a first longitudinal cross section and a second thread portion having a second longitudinal cross section narrower than the first cross section, whereby the first thread segment abuts against the second thread portion. The relatively broad first cross section is preferably adjacent to the circumferentially overlapping region of the second thread segments, resulting in a relatively narrow thread gap in that region.

Preferably, the first and second threads on the container neck and closure are variable pitch threads, preferably as described in WO97/21602, the entire contents of which are incorporated herein by reference. Preferably, the pitch of an unscrewing thread path defined by the first and the second thread segments is relatively lower in a first region and relatively higher in a second region displaced from the first region in an unscrewing direction. The pitch of the thread path in the first region is preferably substantially constant. The first region normally includes the position at which the closure is sealed on the container neck. Preferably, the first region extends for 20°-40° about the circumference of the container neck or the closure skirt. Preferably, the pitch of the lower thread surface in the first region is in the range of 1° to 12°, more preferably 2° to 8°.

Preferably, the second region is adjacent to the first region of the thread path. Preferably, the pitch of the helical thread path in the second region is substantially constant, and the second region preferably extends for 15° to 35° about the circumference of the container neck or the closure skirt. Preferably, the pitch of the thread path in the second region is in the range of 15° to 35°.

The use of a variable pitch thread renders it easier to combine fast-turn threads having a steep average pitch that are elderly- and child-friendly with pressure safety. A problem that could arise with fast-turn threads is that they are steeply pitched, which results in a tendency to back off from the fully secured position on the container neck when the container is pressurized. This problem can be overcome by using bayonet-type threads, but the use of bayonet-type threads results in a number of different problems, as described above. In contrast, the variable pitch threads solve the problem of backing off of the closure under pressure, whilst retaining all of the advantages of continuous, fast-turn threads.

Preferably, the helical unscrewing thread path further comprises a third region adjacent to the second region, wherein the third region has a relatively low pitch. Preferably, the third region has a relatively constant pitch, preferably in the range 1 to 12°, more preferably 2 to 8°. The third region preferably includes the position of the closure on the container neck when the closure is blocked at the intermediate gas venting position. The relatively low pitch of the third region reduces the tendency of the closure to override the blocking means at high gas venting pressures.

Preferably, the closure assembly includes a recess in the inner surface of the closure skirt, the recess being located between and circumferentially overlapping two of the plurality of second thread segments to increase the cross-sectional area provided for gas venting between the second thread segments.

It has been found that the thread gap between overlapping portions of adjacent second thread segments may have a cross-section that is too small for optimal gas venting in all circumstances. The recess overcomes this difficulty by increasing the cross-section of the thread gap to increase the rate of gas venting through the thread gap.

The increased cross-sectional area of the venting pathway in the circumferentially overlapping regions of the second thread permits faster venting of pressure from inside the container, and thereby reduces the length of time that the closure is blocked at the intermediate position while venting takes place, without any loss of pressure safety.

Preferably, the recess comprises an elongate groove extending around the closure skirt between the second thread segments in the said overlapping regions. Preferably, the elongate groove extends substantially parallel to the helical thread path. Preferably, the recess comprises an elongate groove in the inside of the closure skirt. Preferably, the longitudinal cross-sectional area of the recess is from 5% to 50% of the mean longitudinal cross-sectional area of the second thread segment portions adjacent to the recess.

The container closure assembly according to the present invention further comprises, separately from the thread segments, complementary locking projections (side catches) on the container neck and on the closure that resist unscrewing of the closure from the fully engaged position on the container neck after the closure has been secured or resecured on the container neck until a predetermined minimum opening torque is applied.

In the container closure assembly according to the present invention, the first and second locking projections (side catches) longitudinally overlap the first and/or the second thread segments when the closure is in said fully engaged position on the container neck. In other words, the first and second locking projections are not located entirely above or below the threads (the terms above and below refer to relative positions along the longitudinal axis of the assembly), but are located, at least in part, radially in-between the threads. The side catches are preferably located adjacent to an end of the threads. This enables the entire thread assembly to be made more compact in the longitudinal (vertical) direction, thereby reducing the total amount of moulding material needed to make the assembly, and the space taken up by the assembly. In certain embodiments, it also enables the neck thread to be made more suitable for consumption directly from the neck.

Typically, the first and second locking elements are situated near the lower end of the threads when the closure is fully secured on the container. Preferably, the first and/or second locking projections do not extend below the lower edge of the first or second thread segments when the closure is in said fully engaged position on the container neck. The term "lower" refers to the part of the neck thread furthest from the opening of the container neck. In such assemblies, the locking projections are preferably located substantially completely radially between the threads and not above or below the threads. Preferably, the locking projections on the neck are not joined at the lower edge to a circumferential flange or shoulder (e.g. the shoulder used to retain a tamper-evident band), thereby enhancing the flexibility of the locking projections and enhancing the "click-to-close" noise.

Further to the aforesaid, at least one, and preferably both of the complementary locking projections on the neck and/or the closure is substantially separate from the thread segments and can flex substantially independently of the thread segments in order to provide the snap-fitting and clearly audible click as the fully secured position of the closure on the neck is reached. In general, a radially innermost vertex of the second locking element on the closure skirt rides over a radially outermost vertex of the first locking element on the container neck as the fully secured position is approached. The second locking element then rides back over the outermost vertex of the first locking element when the closure is removed from the secured position, for example when opening the assembly.

At least one, and preferably both of the complementary locking projections on the neck and/or the closure has a length in the longitudinal direction (i.e. along the rotational axis of the closure assembly) of from about 1 mm to about 6 mm, for example from about 2 mm to about 4 mm. At least one, and preferably both of the complementary locking projections on the neck and/or the closure has a height of from about 0.25 mm to about 2 mm, for example from about 0.5 mm to about 1.5 mm. In any case the height of the locking projections is normally less than the average height of the respective thread segments. At least one, and preferably both of the complementary locking projections on the neck and/or the closure has a maximum width (i.e. around the circumference of the neck or closure skirt) of from about 0.5 mm to about 3 mm, for example from about 1 mm to about 2 mm. At least one, and preferably both of the complementary locking projections on the neck and/or the closure has a ratio of the maximum height to the maximum width of at least about 0.5, more preferably at least 1, for example from about 1 to about 5.

In suitable embodiments, the first locking projection is located longitudinally overlapping with and radially spaced from an upper end of a first thread segment. In other embodiments, the second locking projection is located longitudinally overlapping with and radially spaced from a lower end of a second thread segment. These latter embodiments are preferred, since the first locking projections are then located further from the opening of the container neck. The circumferential spacing between the projections and the respective thread segments in these embodiments is typically from about 1 mm to about 10 mm, for example from about 1 mm to about 4 mm. In these embodiments, the radially spaced locking projections may abut against the thread segments of the other assembly component as the assembly is screwed together. That is to say, the radially spaced projections may define a part of the thread path on the closure or neck. For example, in the case where there are relatively long thread segments on the closure skirt defining a thread path for relatively short thread segments on the container neck, the locking projections on the closure skirt may be radially spaced from the lower end of the relatively long thread segments on the closure skirt and may thereby define an extension at the start of the thread path followed by the thread segments on the neck when the closure is applied to the neck. This method of using the locking projections to form an extension of the thread path on one of the neck or the closure solves the problem of providing larger locking projections that overlap with the threads, but do not interfere with the running of the threads. The locking projections are generally in the line of and, as it were, are extensions of the thread path on one of the neck or the closure.

The assemblies according to the present invention may comprise more than one pair of complementary locking projections on the container neck and the closure. Preferably there are at least two such complementary pairs radially spaced around the neck and closure skirt. There will normally be at least one pair for each thread start, for example there may be four pairs radially spaced around the neck and closure skirt.

Preferably, the locking projections on the neck and the closure skirt are radially positioned such that they are in abutment when the closure is at the fully closed and sealing position on the container neck. That is to say, the projection on the closure has ridden over one side of, and is resting in abutment with the opposite side of, the corresponding projection on the container neck at said fully closed and sealing position. This ensures that there is no play in the cap at said closed and sealing position that could allow leakage from the seal. Preferably, when the projections are in abutment at the closed and sealing position, the closure skirt and/or the projections are still slightly distorted such that a resilient force is exerted between the projections in abutment. This resilient force is leveraged by the abutment into a closing torque between the closure and the neck that urges the closure into the fully closed and sealing position. This can ensure that the respective sealing surfaces of the container neck and the closure are automatically seated against each other, even though the closure may not be screwed down especially tightly. Furthermore, the locking projections allow for considerably lower manufacturing tolerances in the moulding of the assembly, since effective sealing is achieved over a broader range of radial sealing positions due to the interaction between the locking projections and the radial deformation of the closure skirt.

The advantages of locking projections that urge the closure into the sealing position are discussed in detail in WO93/01098, the entire content of which is incorporated herein by reference.

The complementary locking elements according to the present invention provide a number of other important advantages, besides urging the closure into the fully secured and sealing position as described above. Firstly, they prevent accidental backing off of the closure from the fully engaged and sealing position on the container neck due to pressure from inside the container. These elements enable more steeply pitched threads and free running (parallel) threads to be used without risk of the closure unscrewing spontaneously. The use of more steeply pitched threads in turn makes it easier to remove and resecure the closure.

In some embodiments, the locking elements according to the present invention may also provide a positive "click" when the fully engaged and sealing position of the closure on the container neck is reached, thereby giving the user a positive indication that the closure is in the closed (sealed) position. This system also ensures that exactly the right degree of compression is applied between the container and closure to achieve an effective airtight seal.

The assemblies according to the present invention preferably further comprise additional means for forming a pressure-tight seal between the neck and the closure. In certain embodiments the sealing means comprise a compressible liner inside the base portion of the closure for abutting against a lip of the container neck. Preferably, the sealing liner is formed from a compressible elastomer. Optimum sealing is preferably achieved when the elastomeric sealing liner is compressed to between 30% and 70% of its original thickness. A circumferential sealing rib may be provided on the lip of the container neck, or inside the base of the closure underneath the sealing liner, in order to optimise compression of the elastomer to achieve a pressure-tight seal. However, preferably, the lip of the container neck is smooth and rounded in order to optimise its user-friendliness.

In other embodiments, sealing may be achieved without the need for a liner, for example by compression of suitably configured circumferential sealing ribs or fins on the closure cap against the container neck, and or by means of a cylindrical sealing plug that projects concentrically and inside the closure skirt and that forms a seal with the inside of the container neck proximate to the opening.

Especially suitable sealing arrangements are described in WO02/42171, the entire content of which is incorporated herein by reference. Briefly, these sealing arrangements comprise a sealing plug extending from the base portion of the closure inside and substantially concentric with the skirt portion of the closure, wherein the sealing plug comprises a plurality of circumferential sealing ribs on an outer surface of said sealing plug for engagement with said inner surface of the container neck when the closure is secured on the container neck; at least one flexible sealing fin between the sealing plug and the closure skirt for engagement with the lip of the container when the closure is secured on the container neck; and at least one circumferential sealing rib on an inner surface of said closure for engagement with an outer surface of the container neck proximate to said lip when the closure is secured on the container neck.

The arrangement of sealing ribs and sealing fins in WO02/42171 provides surprisingly improved sealing at low sealing forces. Preferably, there are two of said sealing ribs, but in some embodiments there are preferably from 3 to 10 of the ribs, and most preferably 4 to 6 ribs. Preferably, the taper of the inner sealing surface of the container neck is from 1° to 10° from the longitudinal axis of the neck, more preferably from 2° to 6°. Preferably, at least one of the sealing ribs has a substantially triangular cross-section, for example substantially equilateral triangular. This enables the sealing force to be concentrated in the tip of the sealing rib to maximise sealing effectiveness. Preferably, at least one of the sealing ribs has a height in the range of 10 to 500 micrometers, more preferably 50 to 250 micrometers. Such micro sealing ribs are especially effective to concentrate the sealing force and achieve an effective seal with a substantially smooth sealing surface on the container neck. Furthermore, such micro ribs are especially easy to mould in high-speed cap moulding equipment, and to bump off the mould mandrel of the equipment after moulding. The plurality of sealing ribs may have more than one height in order to optimise sealing. For example, the height of the sealing rib closest to the base of the closure may be greater than the height of the sealing rib remote from the base of the closure. This allows the sealing rib closest to the base of the closure (i.e. closest to the lip of the container) to deform more that the sealing rib furthest from the base of the closure.

Preferably, the outer surface of the sealing plug is tapered inwardly from the base of the closure. The mean angle of taper is preferably from 1° to 10° from the longitudinal axis of the neck, more preferably from 2° to 6°.

The sealing fins may have their base in the base of the closure between the skirt and the sealing plug, or they may extend inwardly or outwardly and downwardly from the base of the skirt or the sealing plug. Preferably, at least one of the sealing fins extends in a direction downwardly and outwardly from the base of the closure between the sealing plug and the closure skirt. Preferably, the closure comprises two or four sealing fins extending around the closure in concentric fashion. Preferably, two sealing fins are disposed substantially symmetrically on either side of the container lip to provide a balanced sealing pinch on the lip.

The sealing fins alone may lack sufficient resilience to form a secure pressure-tight seal against the top of the container lip. Therefore preferably at least one stop surface is provided proximate to the base of the closure, positioned and arranged such that at least one sealing fin abuts against the stop surface when the closure is secured on the container neck. Preferably, two flexible fins are provided for sealing on either side of the container lip, as described above, and two stop surfaces are provided at the bases of the sealing plug and the closure skirt for abutment against each of the sealing fins at the fully secured and pressure-tight position.

The sealing arrangements according to WO02/42171 comprises a further circumferential sealing rib on an inner surface of the closure skirt for engagement with an outer surface of the container neck. More preferably, the circumferential sealing rib is located proximate to the base of the closure. Preferably the further circumferential sealing rib has the dimensions and shape as hereinbefore described for preferred embodiments of the sealing ribs on the sealing plug. Most preferably, the further circumferential sealing rib is located at substantially the same height above the base of the closure as one of the circumferential sealing ribs on the sealing plug, whereby it cooperates with the said one of the sealing ribs to provide sealing ribs symmetrically disposed on either side of the container lip to apply a symmetrical sealing pinch.

In a second aspect, the present invention provides a closure cap for a container closure assembly according to the first aspect of the invention.

The preferred features of the closure cap according to this aspect of the invention are as hereinbefore described in relation to the first aspect of the invention. Preferably, the closure cap is formed from thermoplastics by injection moulding.

Specific embodiments of the container closure assemblies according to the present invention will now be described further, by way of example, with reference to the accompanying drawings, in which:—

Figure 1:
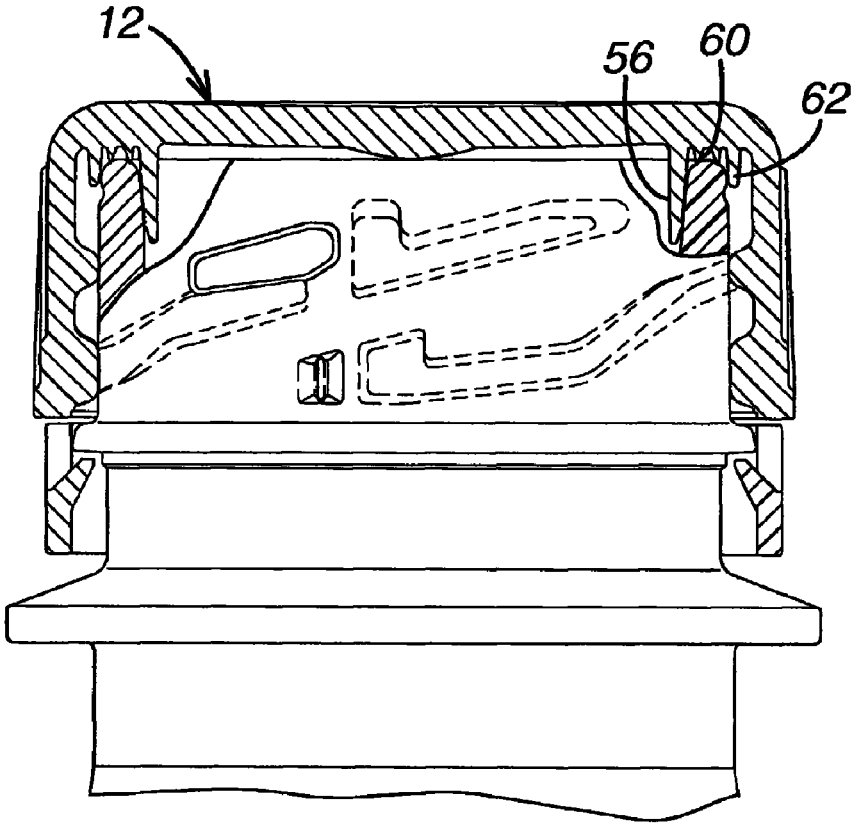
FIG. 1 shows a view of a container closure assembly according to the present invention with the closure in the fully engaged position on the container neck, in which the neck is shown in elevation and the closure is shown with the skirt partially cut away to show the threads on the container neck.
Figure 2:
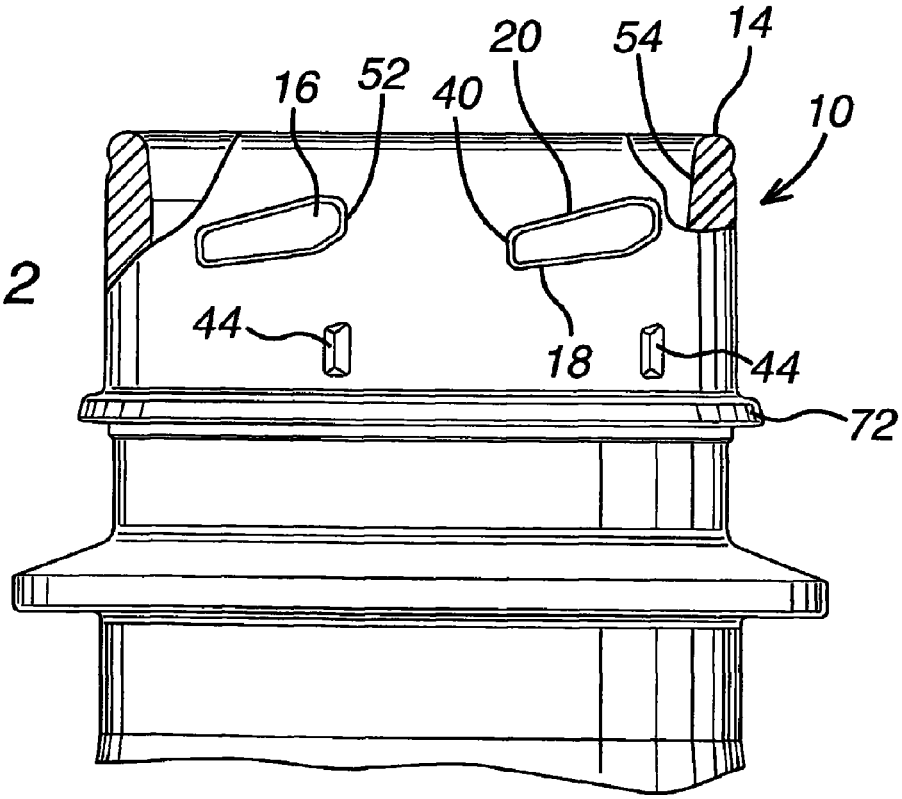
FIG. 2 shows a side elevation view of the container neck of the closure assembly of FIG. 1 after removal of the closure.

Referring to FIGS. 1 and 2, this embodiment is a container closure assembly especially adapted for a carbonated beverage container. The main features of this assembly resemble those of the assembly described and claimed in our International Patent Applications WO95/05322 and WO97/21602 and WO99/19228, the entire contents of which are expressly incorporated herein by reference. However, it is important to note that the threads on the closure and the neck are reversed in the present invention relative to the closure assemblies described in those applications. That is to say, the earlier patent specifications describe in detail assemblies having short thread segments in the closure skirt and longer thread segments on the neck, whereas the present invention provides only short thread segments on the neck and longer thread segments on the closure skirt.

The assembly according to this embodiment includes a container neck 10 of a container for carbonated beverages, and a closure 12. Both the container neck and the closure are formed from plastics material, but the container neck could also be made from glass. The container is preferably formed by injection moulding and blow moulding of polyethylene terephthalate in the manner conventionally known for carbonated beverage containers. The closure is preferably formed by injection moulding of polyethylene. The container neck has a rounded lip 14 to enhance the user-friendliness of the neck.

Figure 3:
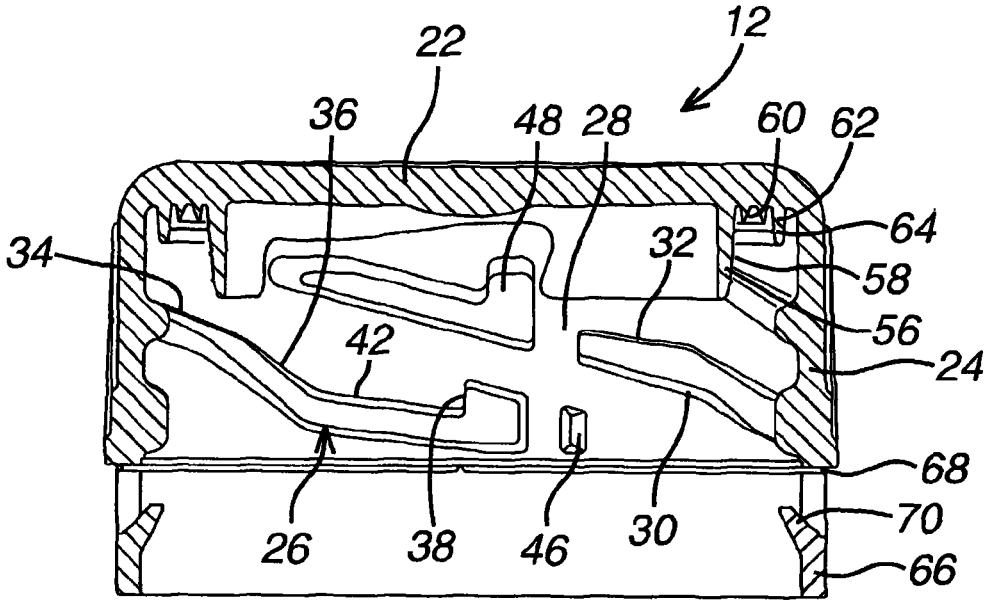
FIG. 3 shows a cross section through the closure of the assembly of FIG. 1.
Figure 4:
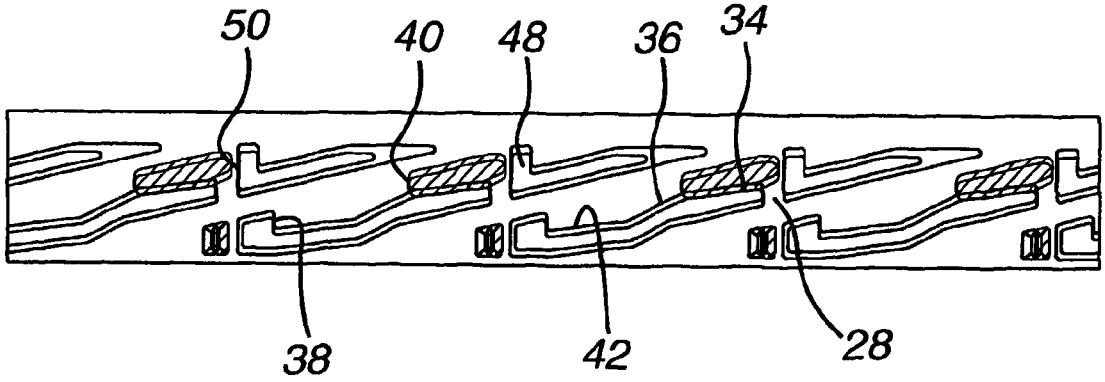
FIG. 4 shows a plane projection of the screw threads of the closure skirt of the assembly of FIG. 1, with the screw threads of the neck shown hatched at the fully secured position of the closure on the neck.

On the container neck 10 there is provided a four-start first screw thread made up of four first thread segments 16, as shown in FIG. 2 and in hatched in the thread developments of FIGS. 3-5. The first thread segments 16 are short thread segments extending about 33° around the neck and having a lower surface 18 with relatively low pitch of about 6° and an upper surface 20 with intermediate pitch of about 13.5°. The first thread segments present a substantially trapezoidal cross-section along the axis of the neck.

Referring to FIGS. 1 and 3, the closure 12 comprises a base portion 22 and a skirt portion 24. The closure skirt 24 is provided with a second screw thread formed from four elongate second thread segments 26. Each of the second thread segments is made up of first and second radially spaced portions separated by a gas venting gap 28 and each having a lower thread surface 30 and an upper thread surface 32. (The term "upper" in this context means closer to the base of the closure, i.e. further from the open end of the closure). Further gas venting gaps could be provided. The upper and lower second thread surfaces 30, 32 give the thread segments substantially trapezoidal side edges that are complementary to the shape of the first thread segments. A substantially continuous, approximately helical thread path for the first thread segments is defined between adjacent second thread segments 26.

A feature of this assembly is the profiling of the upper surfaces 32 of the second thread segments 26, which is described in more detail in our International patent application WO97/21602. The upper thread surfaces 32 in a first, upper region 34 have a substantially constant pitch of only about 6°. The upper region 34 adjoins an intermediate region 36 having a substantially constant, much higher pitch of about 25°. The average pitch of the helical thread path defined by the second thread segments 26 is 13.5°.

The second thread segments 26 also include a pressure safety feature similar to that described and claimed in our International Patent Application WO95/05322. Briefly, the lowermost portion of the second thread segment 26 defines a step 38 to abut against a first end 40 of the first thread segments 16 and block unscrewing of the closure 12 from the neck 10 when the said first thread segments 16 are in abutment with the upper surface 32, i.e. when there is a net force on the closure in an axial direction out of the container neck. A third region 42 of the upper surfaces 32 of the second thread segments situated adjacent to the step 38 also has a low pitch of about 6°.

The container and closure assembly is also provided with complementary locking elements on the container neck and the closure to block unscrewing of the closure from the fully engaged position on the container neck unless a minimum unscrewing torque is applied. These locking elements comprise four equally radially spaced first locking projections 44 on the container neck, and four equally radially spaced second locking projections 46 on the inside of the closure skirt 24. The projections on the container neck are located at the bottom of the thread, where they are least noticeable to a person drinking directly from the container neck. The locking projections 46 on the closure skirt are located level with, and radially spaced by about 2 mm from, the bottom of the threads 26 on the skirt. The locking projections on the closure skirt 24 are formed as a continuation of the closure thread segments 26, whereby the thread segments 16 on the neck 10 can pass smoothly past the locking projections on the neck as the cap is secured on the neck.

Each of the locking 44, 46 projections is substantially in the form of a triangular prism having its long axis aligned with the axis of the closure assembly. The height of each locking projection is about 1.5 mm, and the base width is about 1.5 mm. This ensures that the projections have sufficient strength to snap over each other without permanent deformation.

Each of the second thread segments 26 includes a longitudinally upwardly projecting portion 48 that defines a longitudinal stop surface 50 against which a second end 52 of one of the first thread segments 16 may abut when the closure is fully secured on the neck to block overtightening of the closure on the neck.

This embodiment of the present invention includes a sealing arrangement substantially as described in WO02/42171. The sealing arrangement comprises an inwardly tapered inner surface 54 of the container neck adjacent to the lip 14. A cylindrical sealing plug 56 projects downwardly from the base 22 of the closure cap 12, and is itself tapered substantially in parallel with the inner surface of the neck. However, instead of a simple interference fit between the sealing plug 56 and the container neck, there are provided three substantially circumferential continuous sealing ribs 58 on the outer surface of the sealing plug 56. The circumferential sealing ribs 58 have a substantially equilateral triangular cross-section, and are approximately 150 micrometers high in the unstressed state. However, they deform when pressed against the normally harder material (glass or PET) of the container neck to form the pressure-tight seal. The small dimensions of the sealing ribs 58 enable a pressure tight seal to be achieved without substantial force having to be applied to the sealing plug 56 to form the seal.

Two flexible sealing fins 60 extend downwardly by about 2 mm from the base 22 of the closure 12 between the closure skirt 24 and the sealing plug 56. The sealing fins 60 flex in opposite directions to form seals substantially symmetrically on either side of the rounded top of the container lip 14 as the sealing position is reached. A tight seal is assured by abutment of the sealing fins 60 against respective stop surfaces.

Finally, a larger circumferential sealing fin 62 projects downwardly from the base of the closure for engagement with an outer surface of the container neck 12 close to the lip 14. A further sealing rib 64 on an inside surface of the sealing fin 62 is provided. The unstressed shape and size of the sealing rib 64 is preferably similar to the preferred ranges for the sealing ribs 58 on the plug. Again, the small size of the sealing rib 64 enables an effective seal to be achieved without a high sealing force. Furthermore, in use, the sealing rib 64 is located substantially opposite one of the sealing ribs 58 on the sealing plug 56. The sealing ribs 58, 64 cooperate to pinch the container lip 14, and in combination with the sealing fins 60 provide at least five distinct circumferential sealing surfaces, resulting in highly effective sealing over the whole range of temperature and pressure required for a carbonated beverage container.

The container closure assembly according to this embodiment also comprises a tamper-evident safety feature. This comprises a tamper-evident ring 66 that is initially formed integrally with the skirt 24 of the container closure 12 and joined thereto by frangible bridges 62. The tamper-evident ring 66 comprises a plurality of integrally formed, flexible, radially inwardly pointing retaining tabs 70. A circumferential retaining lip 72 is provided on the container neck 10. Ratchet projections (not present in this embodiment) may also be provided on the container neck below the circumferential retaining lip 72 and radially spaced around the container neck to block rotation of the tamper-evident ring 66 on the container neck 10 in an unscrewing direction. However, it may be preferred to smooth or omit the ratchet projections in order to improve user-friendliness of the neck finish. The structure and operation of the tamper-evident ring feature are as described and claimed in our International Patent Application WO94/11267, the entire contents of which are expressly incorporated herein by reference.

In use, the closure 12 is secured onto the container neck 10 by screwing down in conventional fashion. There are four thread starts, and the closure 12 can be moved from a fully disengaged position to a fully engaged position on the container neck 10 by rotation through about 90°. It can be seen that the thread segments 16 on the neck initially ride past the upper end of the locking projections 46 on the closure skirt, and are thereby guided into a helical thread path. In other words, the locking projections 46 on the skirt 24 define an initial extension of the helical thread path followed by the thread segments 16 on the neck. In this way, the locking projections on the skirt do not interfere or block the free running of the threads.

When the closure is being screwed down, there is normally a net axial force applied by the user on the closure into the container neck, and accordingly the first thread segments 16 on the neck abut against and ride along the lower surfaces 30 of the second thread segments 20 on the closure. It can thus be seen that the first thread segments 16 follow a substantially continuous path along a variable pitch helix. The first and second threads are free-running, which is to say that there is substantially no frictional torque between the thread segments until the fully engaged position is neared. These features of multiple thread starts, a 90° closure rotation, substantially continuous thread path, and free-running threads, all make the closure extremely easy to secure on the container neck, especially for elderly or arthritic persons, or children.

As the closure nears the fully engaged position on the container neck 10, several things happen. Firstly, the tamper-evident ring 66 starts to ride over the retaining lip 72 on the container neck. The retaining tabs 70 on the tamper-evident ring 66 flex radially outwardly to enable the tamper-evident ring to pass over the retaining lip 77 without excessive radial stress on the frangible bridges 68.

Secondly, the initial abutment between the sealing plug 56 and sealing fins 60, 62 in the container closure base and the sealing lip 14 on the container neck results in a net axial force on the closure in a direction out of the container neck. This pushes the thread segments 16 out of abutment with the lower surfaces 30 of the projecting portions of the second thread segments 26 and into abutment with the upper surfaces 32 of the projecting portions of the second thread segments 20. More specifically, it brings the first thread segments 16 into abutment with the upper regions 34 of upper thread surfaces 32. Continued rotation of the closure in a screwing-down direction causes the first thread segments 16 to travel along the upper regions 34 until the final, fully engaged position shown in FIGS. 1 and 4 is reached. The low pitch of the upper surfaces 34 means that this further rotation applies powerful leverage (camming) to compress the sealing plug 56 and sealing fins 60, 62 against the container lip 14 in order to achieve an effective gas-tight seal.

Thirdly, as the fully closed position is reached, the locking projections 46 on the closure skirt flex and ride over the complementary locking projections 44 on the container neck. At the fully closed position, the complementary locking projections remain in abutment, such that the closure skirt is still slightly deformed. The resilient restoring force exerted by the closure skirt is leveraged by the projections 44,46 into a closing torque on the assembly, which helps to ensure that sufficiently strong sealing force is applied to the various sealing surfaces of the assembly. It will be appreciated that this effect, coupled with the relatively large size of the projections 44,46, enables effective sealing to be achieved even if the locking projections 44,46 are not moulded to a very high tolerance.

Finally, as the fully engaged position of the closure 12 on the container neck 10 is reached or passed, the second ends 52 of the first thread segments 16 may come into abutment with the stop shoulders 50 projecting from the second thread segments 26, thereby blocking further tightening of the closure that could damage the threads and/or distort the sealing fins and ribs on the closure.

When the closure 12 is in the fully engaged position on the container neck 10, the lower surfaces 18 of the first thread segments 16 abut against the upper regions 34 of the upper thread surfaces 32 of the projecting portions of the second thread segments 26, as shown in FIGS. 1 and 4. The lower surface 18 of the first thread segments 16 has a low pitch to match that of the upper regions 34, so as to maximise the contact area between the projecting portions in the regions 34, and thereby distribute the axial force exerted by the closure as evenly as possible around the container neck. Because of the low pitch in the regions 34, relatively little of the axial force emerging from the container neck due to pressure inside the container is converted into unscrewing rotational force by the abutment between the thread surfaces in this position. This greatly reduces the tendency of the closure to unscrew spontaneously under pressure. Spontaneous unscrewing is also prevented by the abutment between the first and second locking projections 44, 46. An advantage of the assembly is that the reduced tendency to unscrew spontaneously due to the low pitch of the thread in the lower regions 34 means that the minimum opening torque of the locking projections 44, 46 can be reduced without risk of the closure blowing off spontaneously. This makes the closure easier to remove by elderly or arthritic people, or by children, without reducing the pressure safety of the closure.

In use, the closure is removed from the container neck by simple unscrewing. An initial, minimum unscrewing torque is required to overcome the resistance of the locking projections 44, 46. Once this resistance has been overcome, essentially no torque needs to be applied by the user to unscrew the closure. The internal pressure inside the container exerts an axial force on the closure in a direction emerging from the mouth of the container, as a result of which the first thread segments 16 ride along the upper surfaces 32 of the second thread segments 26 as the closure is unscrewed. The first thread segments 16 initially ride along the upper regions 34, and then along the steeply pitched intermediate regions 36 of the upper surface of the second thread segments 20. The first thread segments 16 then come into abutment with lower projecting portion 38 of the second thread segments 26. In this position, further unscrewing of the closure is blocked while gas venting takes place along the thread paths. It should also be noted that, in this intermediate gas venting position, the first thread segments 16 abut primarily against the region 42 of the upper surface of the second thread segments 26. The low pitch of this region 42 results in relatively little of the axial force on the closure being converted into unscrewing rotational torque, thereby reducing the tendency of the closure to override the pressure safety feature and blow off.

Once gas venting from inside the container neck is complete so that there is no longer axial upward force on the closure, the closure can drop down so as to bring the thread segments 16 into abutment with the lower surfaces 30 of the second thread segments 26. In this position, unscrewing can be continued to disengage the closure completely from the container neck.

The above embodiment has been described by way of example only. Many other embodiments of the present invention falling within the scope of the accompanying claims will be apparent to the skilled reader. In particular, the present invention is not limited to carbonated beverage containers, or to containers formed from moulded thermoplastics.

The invention claimed is:

1. A threaded container closure assembly, said assembly comprising:

a container neck having an opening;

a closure for said neck, the closure having a base portion and a skirt portion;

a first screw thread on the neck, said first screw thread comprising one or more first thread segments, and a second screw thread on an inner surface of the skirt of the closure, said second screw thread comprising one or more second thread segments define a continuous helical thread path along which said closure travels from a fully disengaged to a fully secured position of the closure on the container neck and being configured to enable a user to secure, remove and resecure the closure into a sealing position on the neck by rotation of the closure on the neck;

a first locking projection on the container neck separate from the first thread segments and a second locking projection on the inner surface of the skirt of the closure separate from the second thread segments, said first and second locking projections being configured to resist unscrewing of the closure from the fully engaged position on the container neck after the closure has been secured or resecured on the container neck until a predetermined unscrewing opening torque is applied;

wherein said first and second locking projections longitudinally overlap the first or the second thread segments when the closure is in the fully engaged position on the container neck;

the height of said locking projections is such that the radially innermost vertex of the second locking element rides over a radially outermost vertex of the first locking element as the fully secured position is reached; and the first locking projection is located longitudinally overlapping with and circumferentially spaced from an upper end of a first thread segment, or said second locking projection is located longitudinally overlapping with and circumferentially spaced from a lower end of a second thread segment, whereby the said first or second locking projections define an extension of the thread path defined by the thread segments on the neck or the closure.

2. A container closure assembly according to claim 1, wherein the first and/or second locking projections have sufficient strength to snap over each other without permanent deformation.

3. A container closure assembly according to claim 1 or 2, wherein for at least one of said locking projections the ratio of the maximum height to the maximum width is at least 0.5.

4. A container closure assembly according to claim 1, wherein said first and second locking projections are situated near the bottom of the threads when the closure is fully secured on the container.

5. A container closure assembly according to claim 1, wherein said first thread segments are shorter than said second thread segments.

6. A container closure assembly according to claim 1, wherein there are from 2 to 32 of said first thread segments.

7. A container closure assembly according to claim 1, wherein there are from 4 to 16 of said first thread segments.

8. A container closure assembly according to claim 1 further comprising mutually engageable elements on the neck and the closure to block or restrict rotation of the closure in an unscrewing direction beyond an intermediate position when the closure is under axial pressure in a direction emerging from a container neck.

9. A container closure assembly according to claim 1, wherein said first and second screw threads have at least four thread starts.

10. A container closure assembly according to claim 1, wherein the first and second locking projections are configured such that they are in abutment when the closure is at the fully closed and sealing position on the container neck, and the closure skirt and/or the projections are slightly distorted at said sealing position such that a resilient force is exerted between the projections in abutment to urge the closure into said fully closed and sealing position.

11. A container closure assembly according to claim 1, wherein the closure can be moved from a fully released to a fully engaged position on the container neck by a single smooth rotation through 360 degrees or less.

12. A container closure assembly according to claim 11, wherein the closure can be moved from a fully released to a fully engaged position on the container neck by a single smooth rotation through 160 degrees or less.

13. A container closure assembly according to claim 12, wherein the closure can be moved from a fully released to a fully engaged position on the container neck by a single smooth rotation through 90 degrees or less.

* * * * *